United States Patent [19]

Brouwer et al.

[11] 4,450,874

[45] May 29, 1984

[54] YARN CLAMP

[75] Inventors: Charles W. Brouwer, Greenwich, R.I.; Larry C. Cowan, York, S.C.

[73] Assignee: Leesona Corporation, Warwick, R.I.

[21] Appl. No.: 436,463

[22] Filed: Oct. 25, 1982

Related U.S. Application Data

[62] Division of Ser. No. 223,203, Jan. 7, 1981, Pat. No. 4,362,189.

[51] Int. Cl.[3] ..... D03D 47/00

[52] U.S. Cl. ..... 139/429; 139/450

[58] Field of Search ..... 139/429, 450, 453; 112/253, 302; 188/65.1, 67

[56] References Cited

U.S. PATENT DOCUMENTS

| | | | |
|---|---|---|---|
| 3,393,712 | 7/1968 | Fransen | 139/450 |
| 3,565,121 | 2/1971 | Suaty et al. | 139/453 |
| 3,791,418 | 2/1974 | Pfarrwaller | 139/453 |
| 4,381,806 | 5/1983 | Grigas | 139/450 |

FOREIGN PATENT DOCUMENTS

| | | | |
|---|---|---|---|
| 39561 | 11/1981 | European Pat. Off | 139/450 |
| 2037158 | 2/1971 | Fed. Rep. of Germany | 139/450 |
| 598981 | 3/1978 | U.S.S.R. | 139/450 |

*Primary Examiner*—Henry Jaudon

*Attorney, Agent, or Firm*—Burnett W. Norton

[57] ABSTRACT

An improved solenoid actuated yarn clamp for controlling the flow of a moving strand of yarn particularly in conjunction with a fluid weft insertion loom. The improved clamp is double acting, being displaced positively between an operative yarn clamping position and an inoperative position releasing the yarn for further movement. The actuation of the clamp in both directions preferably occurs in two stages in which a relatively movable portion of the armature is first attracted into engagement with the energized solenoid, resulting in enhancement of the flux path of the solenoid, causing movement of the remainder of the armature. A preferred electronic circuit for regulating the actuation of the improved clamp is also disclosed which permits the adjustment of the clamping and nonclamping portions of the operative cycle of the clamp.

8 Claims, 7 Drawing Figures

YARN CLAMP

CROSS-REFERENCE TO RELATED APPLICATIONS

This application is a division of co-pending application Ser. No. 223,203 filed Jan. 7, 1981 now U.S. Pat. No. 4,362,189.

FIELD OF THE INVENTION

This invention relates to an improved yarn clamp for controlling the movement of a strand of yarn, particularly in conjunction with the insertion of such strand within the shed of a weaving loom by means of a fluid insertion or projection system, and is concerned more particularly with a solenoid activated double acting yarn clamp providing positive clamping action.

BACKGROUND OF THE INVENTION

It is now well known in the textile art that weaving can be carried out at unusually high speeds and enhanced efficiency by means of so-called fluid weft insertion looms in which the weft strand is projected within the warp shed of the loom across the width of the loom by means of a burst of a fluid, such as air or even water, emitted under pressure from a propulsion nozzle disposed at one side of the loom and aimed towards the opposite side. The operation of looms of this type requires careful control of the movement of the yarn being inserted therein since during the insertion stage of the weaving cycle, the yarn must be able to be delivered freely to the insertion nozzle and thence across the loom shed while during other stages, it becomes necessary to positively restrain or clamp the yarn, during for example the accumulation of the supply of yarn for the next insertion cycle. These looms operate at levels of several hundred cycles or picks per minute or even higher and must be designed for a minimum of several million operating cycles at the very least with a minimum requirement for maintenance, and yarn clamps of the type previously known in this art are poorly suited for trouble-free operation during so large a number of cycles and, moreover, tend to lack the rapidity of operating response that is ideally needed for controlling the movement of the yarn under these conditions.

The object of the present invention is consequently to provide an improved yarn clamp characterized by an extraordinary durability and length of trouble-free operation and which, moreover, is capable of extremely rapid response under the control of an applied electrical signal.

A further object of the present invention is a yarn clamp which is movable between operative and inoperative positions in two steps or stages, thereby achieving an enhanced acceleration of its operating response.

A further object of the invention is a yarn clamp of the type described which is controlled by means of an electronic circuit designed following initiation by the application of a control signal to control the actuation of the clamp automatically through one complete cycle, with the possibility of readily adjusting the respective durations of the clamped and unclamped portions of that cycle.

These and other objects will become apparent from the following detailed description of the invention when read in conjunction with the accompanying drawings.

BRIEF DESCRIPTION OF THE DRAWINGS

FIGS. 2 and 3 are detailed views of the solenoid operated yarn clamp in which:

FIG. 2 is a top view, taken in section generally along line 2—2 of FIG. 3, to reveal the interior of the unit;

FIG. 3 is a vertical cross-section view taken substantially along lines 3—3 of FIGS. 2 and 4, while

DETAILED DESCRIPTION OF THE INVENTION

While the improved clamp of the present invention can be employed in association with a variety of different weft insertion systems and indeed for yarn clamping purposes generally, it is preferably associated with a weft insertion system as described and claimed in application Ser. No. 223,203, filed Jan. 7, 1981 and for a complete understanding of the details of the system found there, reference may be had to the complete contents of that application. In order to convey here a broad understanding of the type of context in which the improved clamp of this invention is preferably utilized, the following is a general description of the principal components of the arrangement employed for manipulating the yarn during its insertion as a weft in the shed of a loom, not shown.

A. Overall System

Figure 1:
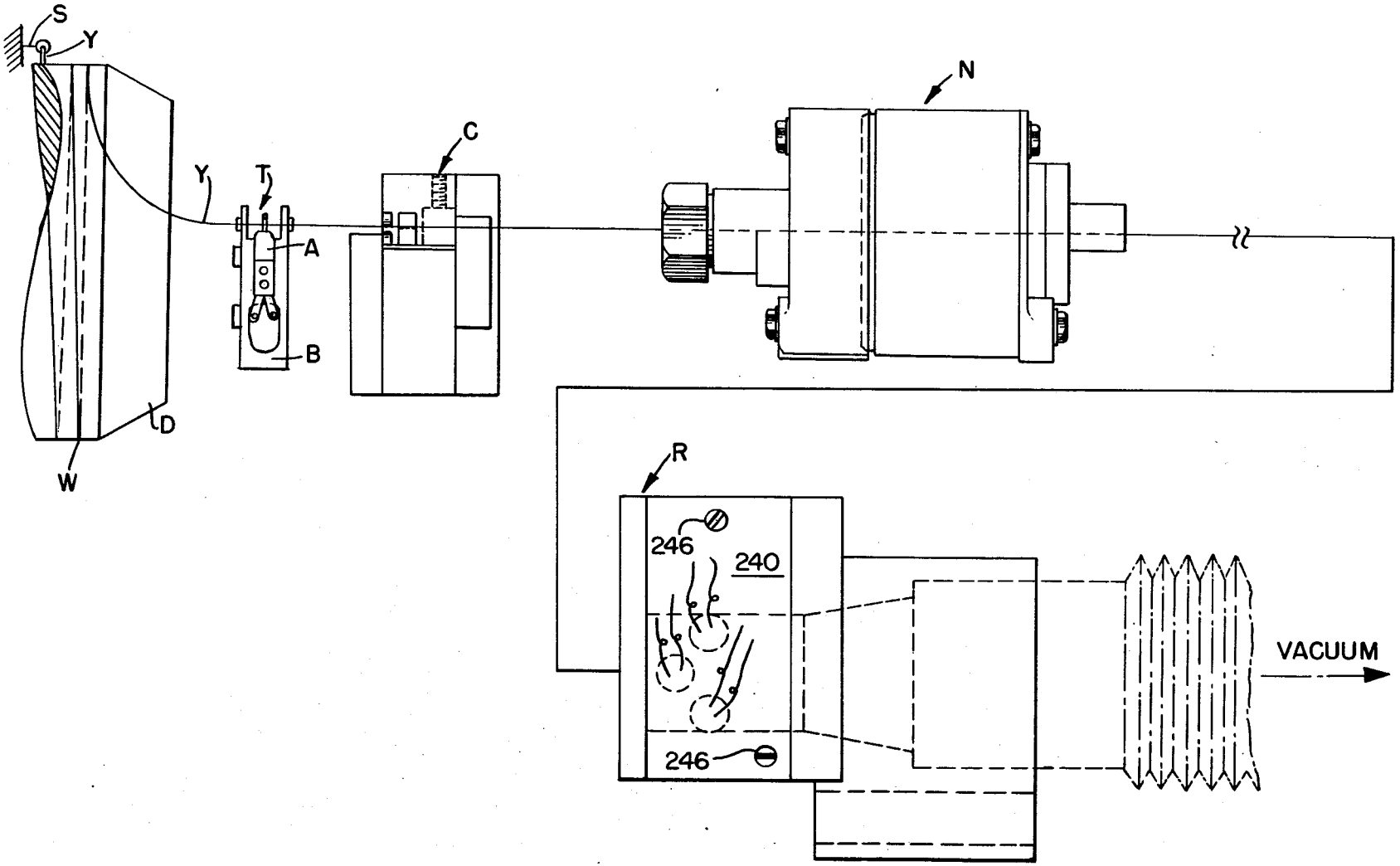
FIG. 1 is a side elevational view, somewhat idealistic, of the several individual event sensing units operative in the monitoring system of the invention arranged in sequence generally in operative relation as in a loom, all of the working parts of the loom, however, including supporting members for the units, etc., being omitted for sake of clarity, except as needed for an adequate understanding of such relation, e.g. of the yarn storage means.

An overall view of the arrangement of the sensing units employed in the monitoring system of the present invention appears in FIG. 1 wherein the components of the loom which have no material relation to the present invention have been omitted for sake of clarity. Thus, all of the interior loom components which form and define the shed, etc., do not appear in FIG. 1, which is broken away to suggest this absence. FIG. 1 does show the end of the yarn metering and storage unit which functions to meter out the appropriate length of yarn according to the width of the loom in question, and store the same in readiness for delivery to the insertion nozzle when needed. The yarn metering and storage unit is the same as disclosed in the above identified related application, Ser. No. 64,180, and for further details of its structure and operation, reference may be had to the disclosure of that application.

As shown in FIG. 1, the yarn Y is delivered from a supply source not shown through a fixed yarn stop in the form, for example, of a guide aperture onto the surface of a storage drum D where it is collected into coils or windings W. From the coils W, the yarn passes through a yarn withdrawal or delivery monitoring unit generally designated T capable of sending a sudden rise in yarn operating tension incidental to complete withdrawal of the stored yarn supply from storage drum D, a solenoid-actuated yarn clamp generally designated C, which positively grips and holds the yarn during its accumulation on the storage drum and then releases the yarn preparatory to the weft insertion phase of the cycle, the weft insertion nozzle generally designated N which when actuated emits a blast of pressurized air through the throat thereof, and a yarn reception unit generally designated R which includes a suction tube for aspirating the leading yarn end therein with an associated sensing unit for sensing the actual arrival of the yarn end therein.

B. Improved Solenoid-Actuated Yarn Clamp

While it is within the scope of the broad concept of the present invention to utilize any type of solenoid-actuated yarn clamp and to derive a control signal from the actuation of that clamp in any of the ways available to do so in the art, there has been developed a special high speed solenoid-actuated clamp assembly that possesses operating characteristics peculiarly suitable for purposes of the overall monitoring system of the invention. This specially designed preferred clamping unit C is illustrated in FIGS. 2 through 5.

The solenoid is enclosed within the housing generally designated 71 the structure of which obviously can be subject to broad variation, but in the illustrative embodiment is constituted of a housing body 73 having bottom, top, opposed end walls and one side wall, and a removable side wall cover 75 forming the other side wall. The interior of the body is open and is divided into a shallow top compartment 77 together with a larger lower compartment 79 separated by a partition 82 which is interrupted as at 83 for a purpose to be explained later. The interior floor of the bottom wall of housing body 73 has two sections 85*a*, 85*b* the planes of which are relatively slightly inclined, say about 5°–10°, with an intermediate recess 87. Each of the floor sections 85*a*, 85*b* carries one of the coils or windings 89*a*, 89*b* of the solenoid and the area of these coils therefore diverge slightly, as indicated by the angle $\alpha$ between the cotted lines at the right of FIG. 9, and being about 5°–10° as explained.

Each of the solenoid windings 89*a* and 89*b* includes a center core 91*a*, 91*c* formed of soft iron with good magnetic properties and the mutually facing inner ends of these cores project somewhat beyond the corresponding limits of the windings with their end faces spaced apart a short distance and diverging at the same small angle $\alpha$. The opposite end of each of the center cores 91*a*, 91*b* is formed as an L-shaped pole piece 93*a*, 93*b* also constituted of strongly magnetic soft iron, having the upstanding leg 95*a,b* thereof abutting the outward end of the core and its base leg passing beneath the windings to terminate in line with the plane of the end face of the associated core, thus, in effect, both poles of the magnetic core of each winding are located at the same end of the winding with their ends in alignment but in vertically spaced apart relation. The aligned end faces of the poles are separated by a space 99 and planes passing therethrough intersect at the same small angle $\alpha$.

Within the space 99 separating the poles of the solenoid windings is a two-piece or duplex armature of which the premier body 101 has a generally rectangular yoke-like configuration, with its central area open as at 103. The lower end of body 101 extends into recess 87 in the housing body floor and is pivoted there for rocking movement around a transverse axis 105. Within the open central area 103 of the primary body 101 swings a secondary armature element 107, pivoted at its upper end of a pin 109 anchored in the upper ends of the primary body. As best seen in FIG. 10, the axes of the opposed solenoid windings 89*a, b* intersect at approximately the midpoint in the vertical dimension or height of the duplex armature assembly just described and well below the support axis for the swinging secondary element 107. It will be seen that the armature assembly as a whole is free to pivot bodily in the space 99 between the end faces of the opposed poles of the windings while the secondary armature element can swing independently.

Figure 3:
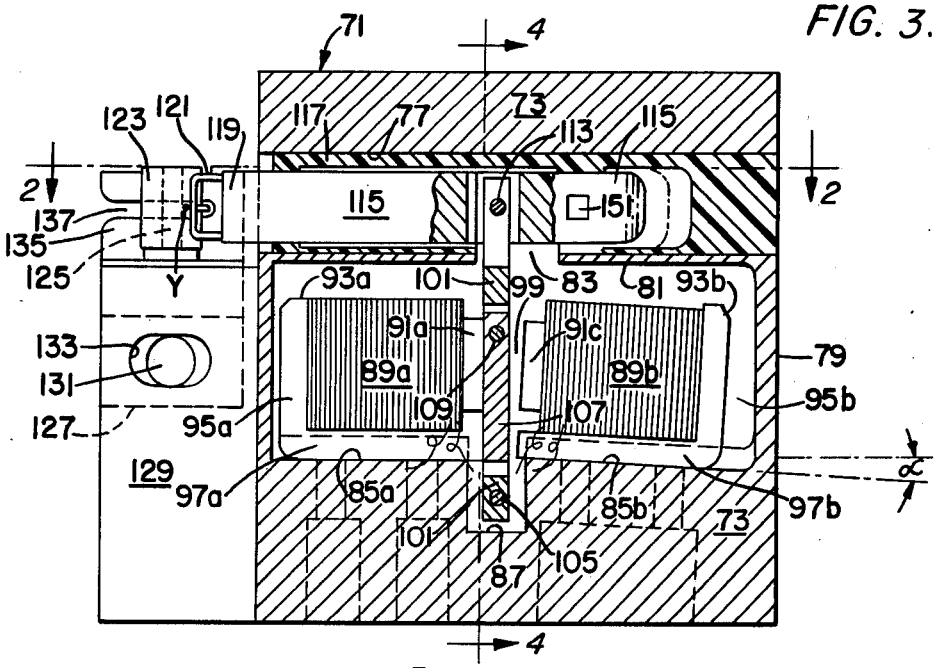
Figure 4:
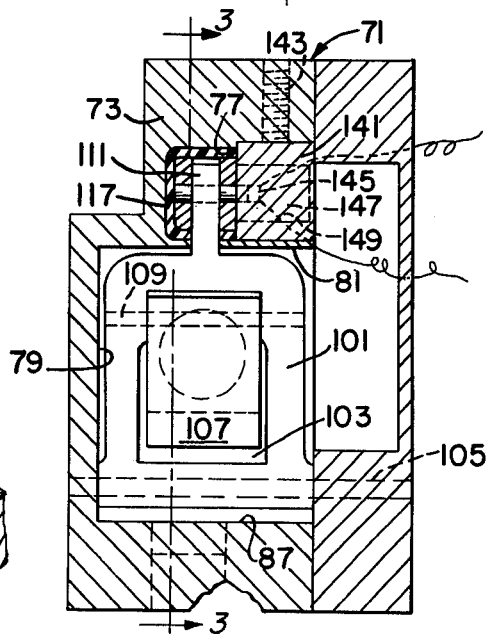
FIG. 4 is a transverse cross-section view taken substantially along line 4—4 of FIG. 3.
Figure 5:
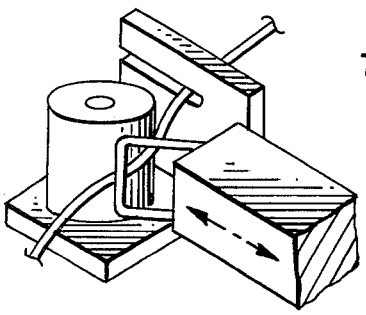
FIG. 5 is an enlarged detailed view in perspective of the working end of the clamp of the invention, showing the relation in operative clamped position of the clamping bale, the fixed cylindrical clamping drum and the yarn clamped therebetween.

The operation of the solenoid so far described is as follows: Assuming the duplex armature to be in a starting position abutting core 91*a*, as shown in FIG. 3, as the opposite winding 89*b* is energized (the electrical leads to the windings being omitted as unnecessary), the duplex armature responds in two-step fashion. Maximum magnetic field flux will exist across the end of pole piece 97*b* and the lower end of secondary element 107. The secondary element being freely swingable swings under the attracting force of this magnetic flux into contact with the adjacent end of the L-shaped pole piece 93*a, b*. due to this contact, the total air gap in the flux field is reduced and the flux field across the gap between the core 91*b* and the swingable secondary element 107 is thereby intensified which increases the magnetic attractive force of the coil for the upper end of secondary element 107 therefore bodily moves into contact with the core and, in so doing, carries along the primary yoke-shaped armature element 101. It has been found that this two-step action of the duplex armature actually achieves a significantly accelerated virtually instantaneous response of the armature which is highly desirable for high speed operation as is required in the operating loom.

The upper end of the primary yoke-like armature element is extended in tongue-like fashion as at 111 and privotally connected by a pin 113 to an elongated tubular slide or plunger 115 mounted for sliding movement within the upper compartment 77 of the housing 71. Preferably, the upper compartment is made oversize and a guide sleeve 117, which can be made of low friction material, such as "Teflon" plastic, is inserted therein, the interior of the guide sleeve being accurately dimensioned to receive tubular plunger 115 and to support the same for free reciprocating movement with a minimum of friction and wear. Tubular plunger 115 projects at one end externally of the housing as at 119 and from end 119 projects a C-shaped bail 121 which functions as the movable part of the yarn clamp. The fixed part or anvil of the clamp takes the form of cylinder 123 preferably mounted for free rotation about a vertical post 125. The bail moves as the plunger reciprocates in a vertical plane which is offset slightly to one side of the axis 125 of the cylinder 123 so that it makes contact with the periphery of the cylinder to one side of dead center. The throw of the bail 121 and sliding plunger 115 is adjusted to ensure the bail impacts firmly against the cylinder periphery and preferably must flex slightly out of a normal planar condition when in its ultimately projected position (as seen in exaggerated fashion in FIG. 2). As a consequence of this arrangement, the impact of the bail against the cylinder causes the cylinder 123 to rotate gradually about post 125 and thereby distribute the wear over its entire periphery and greatly prolong its useful life.

Figure 2:
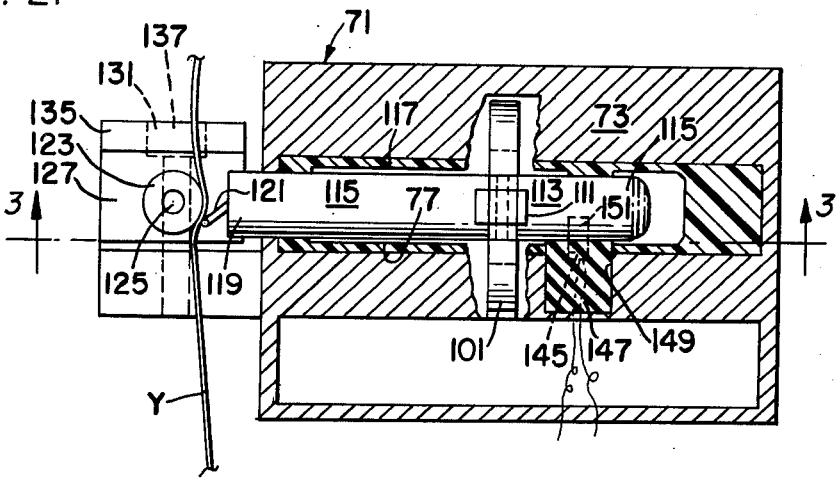

The supporting post 125 for cylinder 123 projects upwardly from a platform 127 attached to a flange-like extension 129 of the front end by means of a bolt 131, the opening for which is horizontally elongated as at 133 to allow the position of cylinder 123 to be adjusted relative to the path of the bail 121. As seen in FIGS. 2 and 3, the back edge of the platform carries an upstanding flange or ear 135 which has a horizontal yarn guiding slot 137 cut therein for stabilizing the path of the yarn Y passing between the bail and cylinder. Preferably, guiding means are provided for the yarn on the front side of the cylinder but such means need not be associated with the housing and are consequently omitted.

As explained, the top, back side, and interior partition 81 of the housing define a three sided channel 77 for receiving the clamp plunger and its guiding sleeve and the open side of this channel is closed by means of an elongated cover block 141 held in position by set screws 143. In accordance with the invention, the actuation of the yarn clamp serves to generate a control signal and while this could be achieved in any number of ways within the skill of the art, a preferred approach is to mount a Hall effect switch 145 is an insulating plug 147 fitted in a recess 149 on the interior side of the cover block for cooperation with a small magnetic plus 151 embedded in the clamp plunger 114. The relative positioning of Hall effect switch 145 and magnetic plug 141 are such that the two coincide with the switch when the clamp carrier is projected full outwardly to pinch the yarn between the bail and the cylinder and, in effect, close the clamp. In this position, the Hall effect switch is closed by the magnetic plug generating a positive control signal which is then utilized for purposes to be described later.

It will be obvious that the front side cover 75 of the housing 71 can be removed for easy access to its interior compartments to permit servicing and/or replacement of any of the parts of the unit. The angle of separation between the poles of the respective cores 91*a, b* is obviously selected to match the pivotal angle of the primary armature body 101. Adjustment of the winding assemblies of the solenoid can be facilitated by anchoring the assemblies on the housing with bolts (not seen) passing through oversize apertures.

Figure 6:
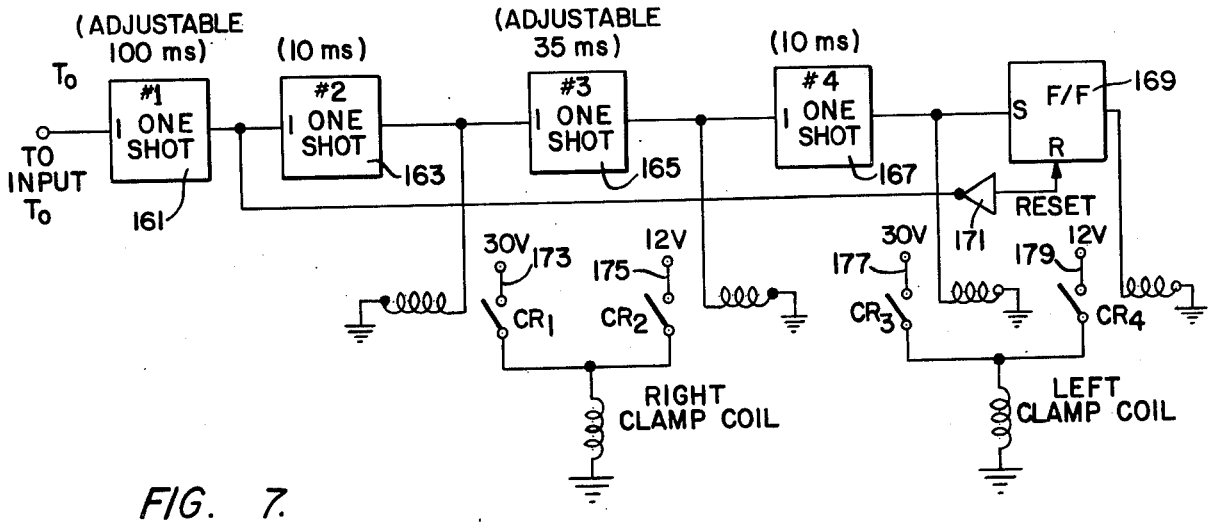
FIG. 6 is a diagram of the electrical circuit for operating the solenoid actuated yarn clamp.
Figure 7:
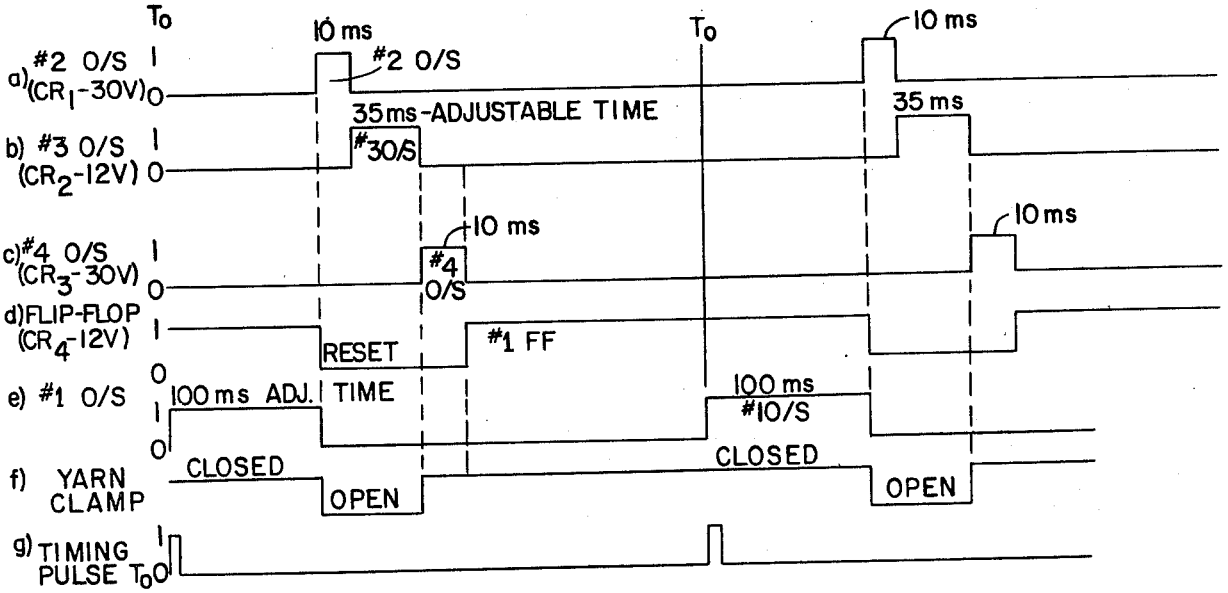
FIG. 7 is a collection of wave forms illustrating the operation of the components of the circuit of FIG. 6.

The electrical circuit for energizing the solenoid windings of the clamp can naturally take many forms but a preferred circuit which has been found to be particularly suitable to the goals of the invention is illustrated in FIG. 6. This circuit utilizes a dual voltage concept in which the solenoid windings are subjected to an excess voltage, above their normal rated voltage, for a brief period at the beginning of each stage of operation of the solenoid and hence receive added energy to achieve positive and rapid response of the armature movement. For example, the windings of the unit in question are designed, say, for normal operation at 12 volts, but for a few milliseconds at the beginning of each transition of the armature, a significantly higher voltage, for example, about 30 volts, is applied across each winding to increase the magnetic flux field set up between their poles and the armature.

Further, it is preferred that this dual voltage concept be applied in a predetermined automatic stepwise sequence whereby when the operative cycle of the solenoid clamp has been once initiated, the unit proceeds automatically through its entire cgcle without further control intervention. The circuit illustrated in FIG. 6 is effective to accomplish this automatic stepwise sequential energization. A timing pulse or signal $T_0$, generated in a manner to be explained more fully later, is applied to the input of a first or #1 one-shot 161. As known, a one-shot is an available electronic device which is capable upon the application thereto of either a rising or falling pulse of emitting an output pulse for a predetermined duration, according to its characteristics. In this case, the #1 one-shot 161 is activated by the rising pulse of the $T_0$ signal and is adapted to be adjusted in the length of its duration, an exemplary duration being 100 ms. The output from #1 one-shot 161 is delivered to the input of a second (#2) one-shot 163 which responds to a falling pulse and emits an output pulse for a period of e.g. 10 ms, and this output pulse in turn passes to a third (#3) one-shot 165 which again responds to a falling pulse and is adjustable in its duration, for example 35 ms. The output next passes to a fourth (#4) one-shot 167 responsive to a falling pulse with a duration of 10 ms, for example, which passes its output signal to the S input of an S-R flip-flop 169 which upon receipt of a positive pulse latches the pulse in the positive mode until it is reset by a signal at its R input. Resetting is accomplished with the output of the #1 one-shot 161, after inversion at the inverter 171 of its polarity so that the flip-flop is reset at the end of the output signal of #1 one-shot 161.

The opposed windings 89*a, b* of the solenois unit are for convenience designated right and left, according to their relationship in FIG. 3 and each winding is connected in parallel to each of a 30 volt and a 12 volt source through corresponding control relays. Relay $CR_1$ controls the 30 volt line 173 and the coil 163 of this relay is connected to the output of #2 one-shot 163 while relay $CR_2$ is in the 12 volt line 175 for the right winding and its coil is connected to the output of #3 one-shot 165. Relay $CR_3$ connects the left solenoid winding to the 10 volt source via line 177 and its coil is connected to the output of #4 one-shot 167, while relay $CR_4$ connects the left coil to the 12 volt source by line 179 and its coil is connected to the output of the flip-flop 169.

The circuit of FIG. 6 in effect constitutes a cascading series of four one-shots plus a terminal flip-flop which series responds automatically to carry out a complete operative cycle upon the receipt of an initiating pulse $T_0$ and then resets itself for the next cycle upon arrival of the next timing pulse. The operation of the circuit is illustrated by wave forms a–g in FIG. 19, and while such operation is undoubtedly self-explanatory, it will be summarized briefly as follows. A brief timint pulse $T_0$ (wave form g) is initially applied to the input of the #1 one-shot (wave form a) which holds the pulse for the adjustable period, in this instance 100 ms. When the output pulse of the #1 one-shot falls, the #2 one-shot is activated in the positive mode (wave form b) and emits a positive pulse for the set period of 10 ms which closes relay $CR_1$ for 10 ms applying 30 volts across the right solenoid coil for that period, opening the clamp (waveform f). When the #2 one-shot output ceases, the #3 one-shot is activated for the set time, in this case 35 ms, and the right coil thereby receives 12 volts over this period via relay $CR_2$ and the clamp remains open. With the expiration of the output of the #3 one-shot, the #4 one-shot is activated for its interval of 10 ms (waveform c) and the 30 volt source is thereby connected via relay $CR_3$ to the left winding of the clamping unit so as to return the solenoid armature and clamp to closed position and upon the expiration of #4 one-shot output, the flip-flop goes positive and latches its output in the positive mode, which connects the left winding to the 12 volt source through relay $CR_4$ and thus holds the 12 volts on the left coil so that the clamp remains in closed position and continues so (to hold the clamp closed) until the flip-flop is reset by the falling pulse of the #1 one-shot simultaneously with the activation of the #2 one-shot to open the clamp when the next timing pulse $T_0$ is received.

The timing of the opening of the clamp obviously has to be correlated with the working cycle of the loom so that the clamp is open to release the yarn for insertion into the loom shed when the loom is at the proper point in its operative cycle, i.e., approaching back dead center, for such insertion to take place. $T_0$ is fixed relative to the loom cycle and will normally correspond to front dead center and the purpose of the adjustable duration of the #1 one-shot is to allow the timing of the clamp actuating sequence to be varied to suit the requirements of the particular weaving cycle.

From these few possible variations in the practice of the invention, one will immediately perceive that the invention is not intended to be restricted to the specific embodiments selected for purposes of illustration and explanation but should be interpreted to encompass other modifications and variations possible in its construction and utilization within the skill of this art, and the invention should not, therefore, be limited in its scope except as required by the limitations of the appended claims.

What is claimed is:

1. In combination with weft insertion means which is operative to propel weft yarn from one side of the shed of a loom to the opposite side thereof on signal while simultaneously being withdrawn from a supply of said weft yarn, the improvement comprising, anvil means over which the weft yarn is directed as said weft yarn is withdrawn from said supply, clamping means, first solenoid means for moving said clamping means in a first direction toward said anvil to pinch said weft yarn between clamping means and said anvil and thereby restrain said weft yarn from advance, second solenoid means spaced from said first solenoid means for moving said clamping means in a second direction to release said weft yarn from said clamping means, and armature means positioned between said first and second solenoid means, said armature means including a swingable portion initially engageable with one of said first and second solenoids upon energization of said solenoid, and a body portion engageable with said one of said solenoids after said swingable portion has been engaged thereby.

2. The combination as set forth in claim 1 wherein said swingable portion is rockably mounted on said body portion.

3. The combination as set forth in claim 1 wherein said armature means is suspended in a first plane, and is swingable into at least one further plane offset from said first plane, said first solenoid means includes a coil having a face residing in said first plane for engagement with said armature means, and said second solenoid means includes a coil disposed in said further plane for engagement by said armature means when swung into said further plane.

4. The combination as set forth in claim 3 wherein said clamping means is moved in said first direction when said armature means is engaged with said second solenoid, and said clamping means is moved in said second direction when said armature means is engaged with said first solenoid.

5. The combination as set forth in claim 1 wherein said anvil is a cylinder.

6. The combination as set forth in claim 1 including sensing means operative to detect movement of said clamping means in said first direction and produce a signal in response thereto.

7. The combination as set forth in claim 6 including further sensing means for operative to detect movement of said clamping means in said second direction and produce a signal in response thereto.

8. The combination as set forth in claim 1 including timing means for alternately energizing said first and second solenoids in timed sequence.

* * * * *